US008282509B1

(12) United States Patent
Michaelson et al.

(10) Patent No.: US 8,282,509 B1
(45) Date of Patent: Oct. 9, 2012

(54) COLLAPSIBLE PITCHING NET FRAME

(75) Inventors: H. Ward Michaelson, Coram, NY (US); John Cummings, West Babylon, NY (US)

(73) Assignee: Golf, Gifts and Gallery, Inc., Powers Lake, WI (US)

( * ) Notice: Subject to any disclaimer, the term of this patent is extended or adjusted under 35 U.S.C. 154(b) by 0 days.

(21) Appl. No.: 12/381,224

(22) Filed: Mar. 9, 2009

(51) Int. Cl.
*A63B 69/00* (2006.01)
*A63B 69/36* (2006.01)
*A63B 63/00* (2006.01)

(52) U.S. Cl. ..... 473/456; 473/197; 273/400

(58) Field of Classification Search ..... 273/398–402; 473/454, 456, 421, 476–478, 197; 108/115, 108/118, 121, 159, 170, 175, 166; 220/9.3, 220/9.4, 6, 7; 248/436, 432, 166, 159, 97, 248/128, 146; 297/16.1, 16.2, 45
See application file for complete search history.

(56) References Cited

U.S. PATENT DOCUMENTS 757,440 A * 4/1904 Croxford ..... 273/342
1,923,152 A * 8/1933 Kohn ..... 473/190
2,744,752 A * 5/1956 Arnold ..... 273/398
3,231,280 A * 1/1966 Coliins ..... 473/195
5,330,199 A * 7/1994 Vand ..... 273/400
6,158,361 A * 12/2000 Zheng et al. ..... 108/118
6,276,548 B1 * 8/2001 Mitchell ..... 220/9.4
6,332,646 B1 * 12/2001 Tseng ..... 297/16.1
6,499,705 B1 * 12/2002 Tsai ..... 248/167
6,659,466 B2 * 12/2003 Searles et al. ..... 273/400
6,672,980 B1 * 1/2004 Walsh ..... 473/478
6,929,230 B2 * 8/2005 Tsai ..... 248/436
6,948,713 B1 * 9/2005 Grunfeld ..... 273/400
7,066,824 B2 * 6/2006 Wenzler ..... 473/197
7,401,785 B1 * 7/2008 Waite ..... 273/400
7,404,601 B2 * 7/2008 Chen ..... 297/16.2
7,540,259 B2 * 6/2009 Pape et al. ..... 119/28.5
7,648,421 B2 * 1/2010 Yoon ..... 473/197
2001/0033057 A1 * 10/2001 Chittenden ..... 273/400
2003/0008721 A1 * 1/2003 Macaluso ..... 473/197
2003/0025272 A1 * 2/2003 Billig et al. ..... 273/400
2003/0234561 A1 * 12/2003 Zheng ..... 297/45
2007/0052178 A1 * 3/2007 Cottrell ..... 273/402
2007/0187897 A1 * 8/2007 Dilling ..... 273/407
2009/0176604 A1 * 7/2009 Harries ..... 473/485
2010/0025934 A1 * 2/2010 Hassman et al. ..... 273/400
2010/0164256 A1 * 7/2010 Salisbury ..... 297/16.2

* cited by examiner

*Primary Examiner* — Mark Graham
(74) *Attorney, Agent, or Firm* — Philip Furgang Furgang & Adwar LLP

(57) ABSTRACT

A foldable device for use in supporting sports nets or the like, the foldable device including: a) a selectively foldable support ring including pivotally secured substantially arcuate sections; and b) a foldable support stand for engaging the ring and having a first open position and a second closed position; and c) at least a part of the ring forming at least one handle when said support stand is in the second position.

5 Claims, 9 Drawing Sheets

COLLAPSIBLE PITCHING NET FRAME

FIELD OF THE INVENTION

The present invention relates to collapsible frame devices capable for supporting objects such as, by way of example only, sports equipment.

BACKGROUND

Sports devices, such as those using nets, as may be used in golf practice devices, are known to have collapsible frames and bases. Collapsible frames offer the advantage of portability for easy transport. Devices such as these are usually used for games where individuals or teams compete by throwing or batting a ball or object into a fixed target. These games are typically played outdoors, but may be played indoors if space permits. Devices of this type that use nets are also advantageous to prevent stray balls from landing on the yard or rolling far away from the device. There is a need for compact, folding support devices for such practice devices as well as other uses.

SUMMARY

Provided is a support device which comprises a collapsible retaining section. The retaining section comprises a front portion. The front portion comprises a first front arcuate member; a second front arcuate member; and a front handle pivotally connected between the first and second front arcuate members. A rear portion comprises a first rear arcuate member; a second rear arcuate member; and a rear handle pivotally connected between the first and second rear arcuate members; and a first pivot joint is pivotally connected to the first front arcuate member and the first rear arcuate member. A second pivot joint is pivotally connected to the second front arcuate member and the second rear arcuate member; and a base section for supporting the retaining section.

The device further includes amongst its features in which the base section comprises a pair of rear support legs pivotally connected to the rear portion; first and second front crossed legs pivotally connected to each other at a crossing point; a first end of the first front crossed leg being pivotally connected to the front portion and extending diagonally therefrom; a first end of the second front crossed leg being pivotally connected to the front portion spaced from the first front leg and extending diagonally therefrom; first and second rear crossed legs pivotally connected to each other at a crossing point; the first rear crossed leg having a first end slidably connected to a first of the pair of rear support legs, and a second end pivotally connected to a base of a second of the pair of rear support legs; and the second rear crossed leg having a first end slidably connected to the second of the pair of rear support legs, and a second end pivotally connected to a base of the first of said pair of rear support legs. Another feature may include wherein the base section further comprises: first and second left side crossed legs pivotally connected to each other at a crossing point; the first left side crossed leg having a first end slidably connected to the first of said pair of rear support legs, and a second end pivotally connected to a base of the second front crossed leg; the second left side crossed leg having a first end pivotally connected to the base of the first of the pair of rear support legs, and a second end pivotally connected to the first end of the first front cross leg; first and second right side crossed legs pivotally connected to each other at a crossing point; the first right side crossed leg having a first end slidably connected to the second of the pair of rear support legs, and a second end pivotally connected to a base of said first front crossed leg; the second right side crossed leg having a first end pivotally connected to the base of the second of said pair of rear support legs, and a second end pivotally connected to the first end of the second front cross leg. The base section may further comprise: a first front pad pivotally connecting the first left side crossed leg and second front crossed leg; a second front pad pivotally connecting the first right side crossed leg and first front crossed leg; a first rear pad pivotally connecting the second left side crossed leg and the second rear crossed leg, to the first rear support leg; a second rear pad pivotally connecting the second right side crossed leg and the first rear crossed leg, to the second rear support leg. Another feature includes a net removably connected to the foldable support ring. The net includes apertures of differing circumference forming a target. The net is foldable. The front and rear handles are curved to fit the shape of a human hand. The first and second pivot joints each include a locking mechanism to define a range of pivoting of front and rear sections.

A method of opening a support device of the type capable of supporting a pitching net frame or the like comprising: providing a frame; grasping front and rear handles; moving the front and rear handles away from each other until the frame assumes a circular form; pivoting of a first front arcuate member in a clockwise direction and a second front arcuate member in a counterclockwise direction about the front handle; pivoting of a first rear arcuate member in a clockwise direction and a second rear arcuate member in a counterclockwise direction about the rear handle; pivoting the first front and first rear arcuate members away from each other about a first pivot joint; and pivoting the second front and second rear arcuate members away from each other about a second pivot joint.

The method may include the features of: wherein the step of moving said front and rear handles causes a base to expand and provide support for the frame; a step of connecting a net to the frame. A method of closing a support frame comprises: grasping front and rear handles; moving the front and rear handles towards each other until the frame assumes a clamshell form; pivoting of a first front arcuate member in a counterclockwise direction and a second front arcuate member in a clockwise direction about the front handle; pivoting of a first rear arcuate member in a counterclockwise direction and a second rear arcuate member in a clockwise direction about the rear handle; pivoting the first front and first rear arcuate members towards each other about a first pivot joint; and pivoting the second front and second rear arcuate members towards each other about a second pivot joint.

The method may also include the step of moving the front and rear handles causes a base to contract and cause the frame to assume a clamshell position.

There is also provided a foldable device adaptable for use in supporting nets or the like, the foldable device comprises a selectively foldable support ring including pivotally secured substantially arcuate sections; and a foldable support stand for engaging the ring and having a first open position and a second closed position; and at least a part of the ring forming at least one handle when the support stand is in the second position.

The device may also include these features where the selectively foldable support ring includes a front portion which comprises a first front arcuate member; a second front arcuate member; and a front handle pivotally connected between the first and second front arcuate members; a rear portion comprising a first rear arcuate member; a second rear arcuate member; and a rear handle pivotally connected between the first and second rear arcuate members. There is also a first pivot joint pivotally connecting the first front arcuate member and the first rear arcuate member; a second pivot joint pivotally connecting the second front arcuate member and the second rear arcuate member. The foldable support stand may also include a pair of rear support legs pivotally connected to the rear portion; first and second front crossed legs pivotally connected to each other at a crossing point; a first end of the first front crossed leg being pivotally connected to the front portion and extending diagonally therefrom; a first end of the second front crossed leg being pivotally connected to the front portion spaced from the first front leg and extending diagonally therefrom; first and second rear crossed legs pivotally connected to each other at a crossing point; the first rear crossed leg having a first end slidably connected to a first of the pair of rear support legs, and a second end pivotally connected to a base of a second of the pair of rear support legs; and the second rear crossed leg having a first end slidably connected to the second of said pair of rear support legs, and a second end pivotally connected to a base of the first of said pair of rear support legs. The device may also include a net removably connected to the foldable support ring. The net may include apertures of differing circumference forming a target. The net is foldable. Another feature is where the front and rear handles are curved to fit the shape of a human hand.

The device may further include amongst its features a support device comprising a front, rear, left side, and right side portion. The front portion comprises a first front arcuate member, a second front arcuate member, and a front pivot joint pivotally connecting the first front arcuate member and the second front arcuate member. The rear portion comprises a first rear arcuate member, a second rear arcuate member, and a rear pivot joint pivotally connecting the first rear arcuate member and the second rear arcuate member. The left side portion comprises a first left side arcuate member, a second left side arcuate member, and a left side handle pivotally connected between the first left side arcuate member and the second left side arcuate member. The right side portion comprises a first right side arcuate member, a second right side arcuate member, and a right side handle pivotally connected between the first right side arcuate member and the second right side arcuate member. A first pivot point may connect the first left side arcuate member and the first front arcuate member. A second pivot point may connect the second front arcuate member and the first right side arcuate member. A third pivot point may connect the second left side arcuate member and the first rear arcuate member. A fourth pivot point may connect the second rear arcuate member and the second right side arcuate member. A base section may also support the collapsible retaining section.

A method of opening a support device of the type capable of supporting a pitching net frame or the like comprising: providing a frame; grasping a left and right side handle; moving the left and right side handles away from each other until the frame assumes a circular form; pivoting of a first front arcuate member in a clockwise direction and a second front arcuate member in a counterclockwise direction about the front pivot joint; pivoting of a first rear arcuate member in a clockwise direction and a second rear arcuate member in a counterclockwise direction about the rear pivot joint; pivoting of the first front arcuate member and a first left side arcuate member about a first pivot joint; pivoting of the second front arcuate member and a first right side arcuate member about a second pivot joint; pivoting of the first rear arcuate member and a second left side arcuate member about a third pivot joint; pivoting of the second rear arcuate member and a second right side arcuate member about a fourth pivot point; pivoting of the first left side arcuate member in a counterclockwise direction about the left side handle; pivoting of the second left side arcuate member in a clockwise direction about the left side handle; pivoting of the first right side arcuate member in a clockwise direction about the right side handle; and pivoting of the second right side arcuate member in a counterclockwise direction about the right side handle.

A method of closing a support device of the type capable of supporting a pitching net frame or the like comprising: grasping a left and right side handle; moving the left and right side handles toward each other until the frame assumes a clamshell form; pivoting of a first front arcuate member in a counterclockwise direction and a second front arcuate member in a clockwise direction about the front pivot joint; pivoting of a first rear arcuate member in a counterclockwise direction and a second rear arcuate member in a clockwise direction about the rear pivot joint; pivoting of the first front arcuate member and a first left side arcuate member about a first pivot joint; pivoting of the second front arcuate member and a first right side arcuate member about a second pivot joint; pivoting of the first rear arcuate member and a second left side arcuate member about a third pivot joint; pivoting of the second rear arcuate member and a second right side arcuate member about a fourth pivot point; pivoting of the first left side arcuate member in a clockwise direction about the left side handle; pivoting of the second left side arcuate member in a counterclockwise direction about the left side handle; pivoting of the first right side arcuate member in a counterclockwise direction about the right side handle; and pivoting of the second right side arcuate member in a clockwise direction about the right side handle.

BRIEF DESCRIPTION OF THE DRAWINGS

In order that the device and method may be more fully understood, it will now be described, by way of example, with reference to the accompanying drawing in which.

DETAILED DESCRIPTION

The device 1 which may support a golf practice net or the like offers a solution for users who want a readily portable device that is collapsible and easy to transport. The collapsibility of the device 1 allows it to be carried or stored easily in any vehicle or other location. When in a collapsed position, the device 1 may assume a clamshell-like shape that is much thus more compact than when it is in an open position. The closed configuration provides a shape that is more amenable to carrying by hand or storage in a vehicle or other location. The collapsible feature also facilitates ease of use since the user may set up, for example, a practice net or the like anywhere in only a few moments. As will be shown, opening the device 1 requires one easy motion as a user grasps two handles and pulls them apart or away from each other. Closing the frame requires an equally easy movement by moving the handles towards each other. For example a frame may be composed of a lightweight metal or plastic composition. This makes the frame very light and easy to transport, while the entire device 1 makes for durability and sturdiness.

Figure 1:
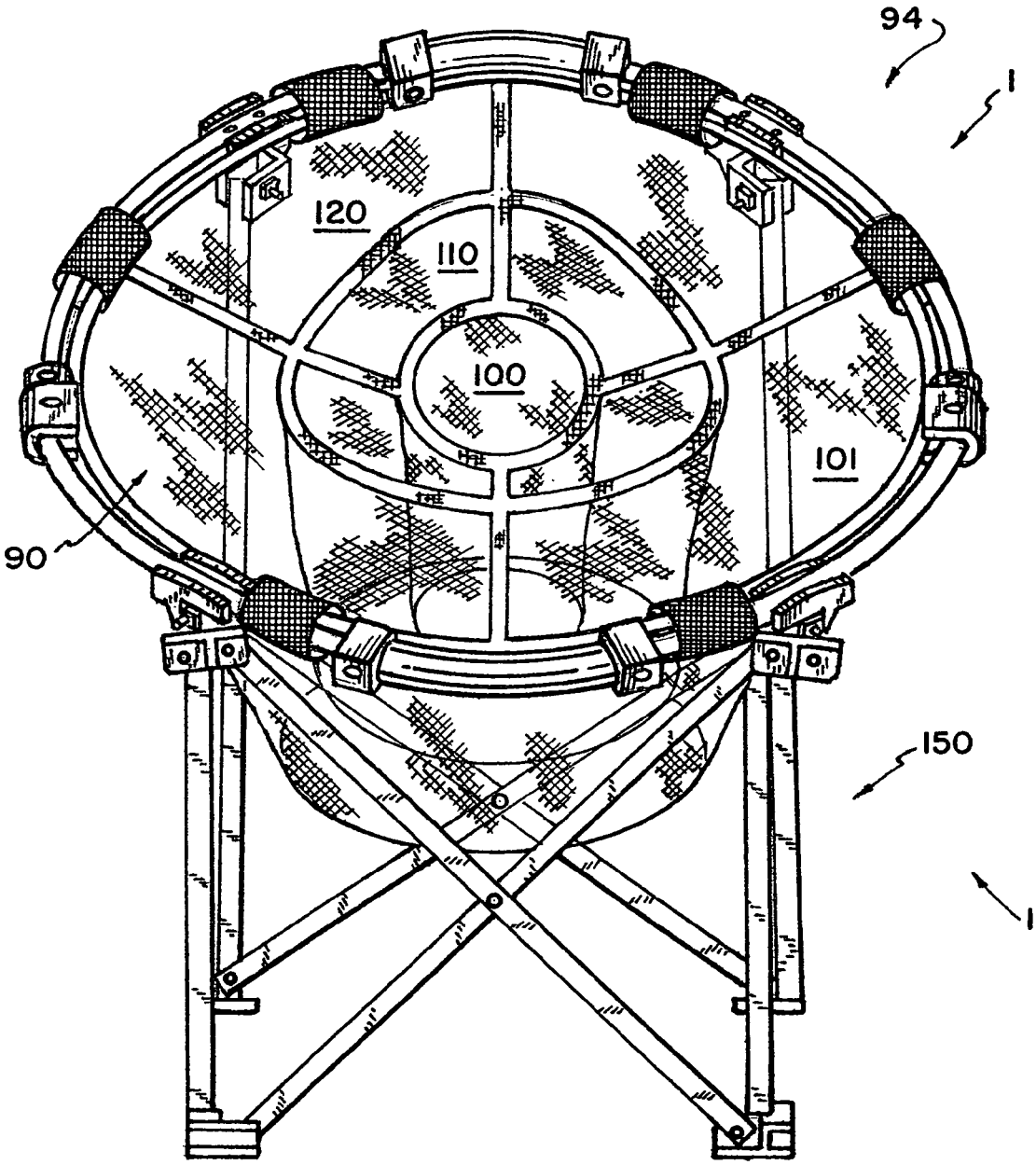
FIG. 1 is a front perspective view of a folding frame support with a practice net in its opened position.

FIG. 1 shows an embodiment of the device 1 which may be used in supporting a practice net for receiving golf balls or the like in an opened position. The device 1 includes a frame supporting a net 101 which may be made of a net-like material. The net 101 may be selectively retained by a frame. The net 101 may define three substantially concentric apertures 100, 110, and 120 which may be arranged as concentric targets 92. Each concentrically mounted target 100, 110, 120 may have different circumferences. In this example golf balls or other sports object may be pitched, driven, or thrown into the targets 92. The nets may be removably attached to a frame 94. The frame 94 may include a retaining support 140 and a base 150 connected thereto. The retaining support 140 and base 150 of the frame 94 may be made of a well-known structural material such as a lightweight metallic alloy composition or plastic. The support 140 may include handles 201, 212 which may be made of any structural material, such as a lightweight composition. Structural material such as a metallic alloy, composition, or plastic may be used for the retaining support 140 and base 150 to provide stability for the device 1 as a whole.

Figure 2:
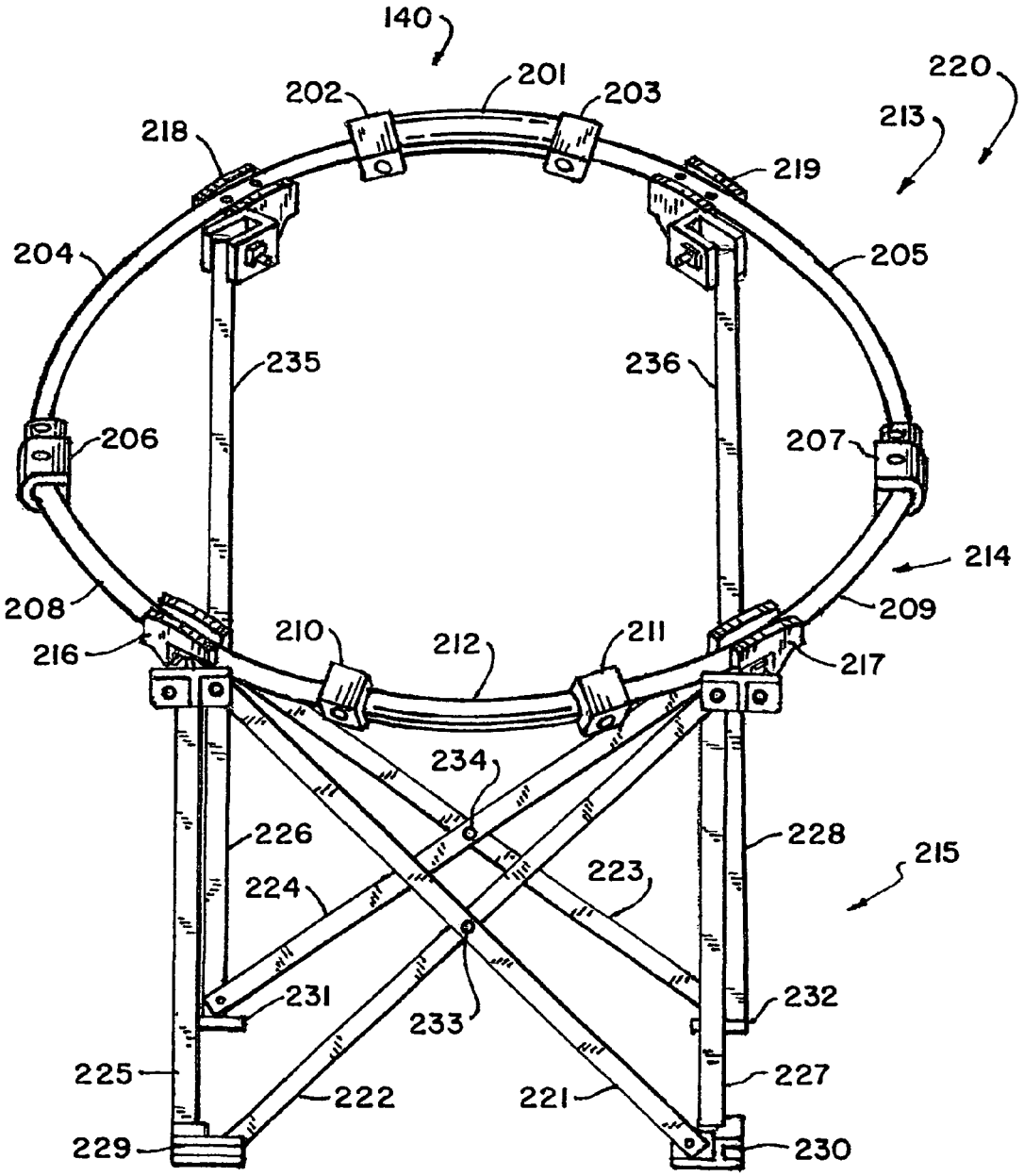
FIG. 2 is a front perspective view of the support frame of the device of FIG. 1 in its opened position, without the net attached.

FIG. 2 shows the device 1 in an open position without the target net 90. The retaining support 140 may comprise a collapsible support section 220 having a front portion 214 and a rear portion 213 which, in the device 1 open position, may take the form of a somewhat circular or elliptical support member or any other regular or irregular geometric shape. The front portion 214 in this example may be formed by a first front arcuate member 208, a second front arcuate member 209 and a front handle 212 connected there between. The front handle 212 may be pivotally connected at side 210 to the first front arcuate member 208 and pivotally connected at side 211, opposite side 210, to the second front arcuate member 209.

In like manner, a rear portion 213 may be formed by a first rear arcuate member 204, a second rear arcuate member 205, and a rear handle 201 connected there between. The rear handle 201 may be pivotally connected at side 202 to the first rear arcuate member 204 and pivotally connected at side 203, opposite side 202, to the second rear arcuate member 205.

A first pivot joint 206 may pivotally connect the first front arcuate member 208 and the first rear arcuate member 204. A second pivot joint 207 pivotally connects the second front arcuate member 209 to the second rear arcuate member 205. Pivotal connections throughout may be made by means of pins or similar means well-known in the art.

The connection of the front portion 214 to the rear portion 215 may form a substantially circular or elliptical frame 220 when in an open position. This circularly shaped frame may be easily collapsed into a clamshell shape which will be described herein below. The circular shaped frame may permit the device 1 to be opened and closed in one seamless motion. This is made possible by the pivotal connection between the arcuate members and the handles. One broad motion of pulling the handles 201, 212 apart or pushing the handles 201, 212 together may cause the frame to move between the open and closed positions, respectively. To further facilitate the ease of opening and closing the device 1, the handles 201, 212 may be curved so as to fit the form of a human hand to provide an ergonomic advantage. The handles 201, 212 may also include grips for receiving the fingers of the user.

A collapsible base 215 may include a pair of rear support legs 235, 236, a pair of front crossed legs 221, 222 and a pair of rear crossed legs 223, 224. The front crossed legs 221, 222 may be pivotally connected at a cross point 233 as by a pivot pin. The rear crossed legs 223, 224 may be pivotally connected at a cross point 234. The left side cross legs 225, 226 may be pivotally connected at a cross point (not shown). The right side cross legs 227, 228 may be pivotally connected at a cross point (not shown). The front crossed legs 221, 222 may be pivotally connected on one side to the front portion by first and second pivot connections 216 and 217 respectively. The pair of rear support legs is pivotally connected to the rear portion 215. The pair of rear crossed legs 221 and 222 may be connected on one side to selectively slide along a length of the rear support legs 235 and 236. Left side cross leg 225 is connected to a slidable connector (not shown) on one side and to a first front pad 229 on the other. Left side cross leg 226 is connected to pivot connection 216 on one side and to a first rear pad 231 on the other. Right side cross leg 227 is connected to the slidable connector (not shown) on one side and to a second front pad 230 on the other. Right side cross leg 228 is connected to pivot connection 217 on one side and to a second rear pad 232 on the other. The first front pad 229 and the second front pad 230 are pivotally connected to the opposite sides of the pair of front crossed legs 221 and 222, forming feet for the base 215. The first rear pad connector 231 and the second rear pad connector 232 are pivotally connected to the opposite sides of the pair of rear crossed legs 223 and 224, forming feet for the base 215, to crossed legs 226 and 228, and to rear support legs 235 and 236. Two front pivot connections 216 and 217 attach to the front portion 214, and two rear pivot connections 218 and 219 attach to the rear portion 213. The front pivot connection 216 and rear pivot connection 219 are attached to pairs of front crossed legs 221 and 222 and rear crossed legs 223 and 224, and two pairs of crossed side legs 225, 226, 227, and 228, with each pair of legs pivotally connected where crossing. The method of opening and closing the device 1 comprises opening the frame by pulling in opposing directions the front and rear handles 201, 212 of the collapsible net retaining section 220 and closing the pitching net frame 220 by pushing in opposing directions the front and rear handles 201, 212 of the collapsible net retaining section 220.

Figure 3:
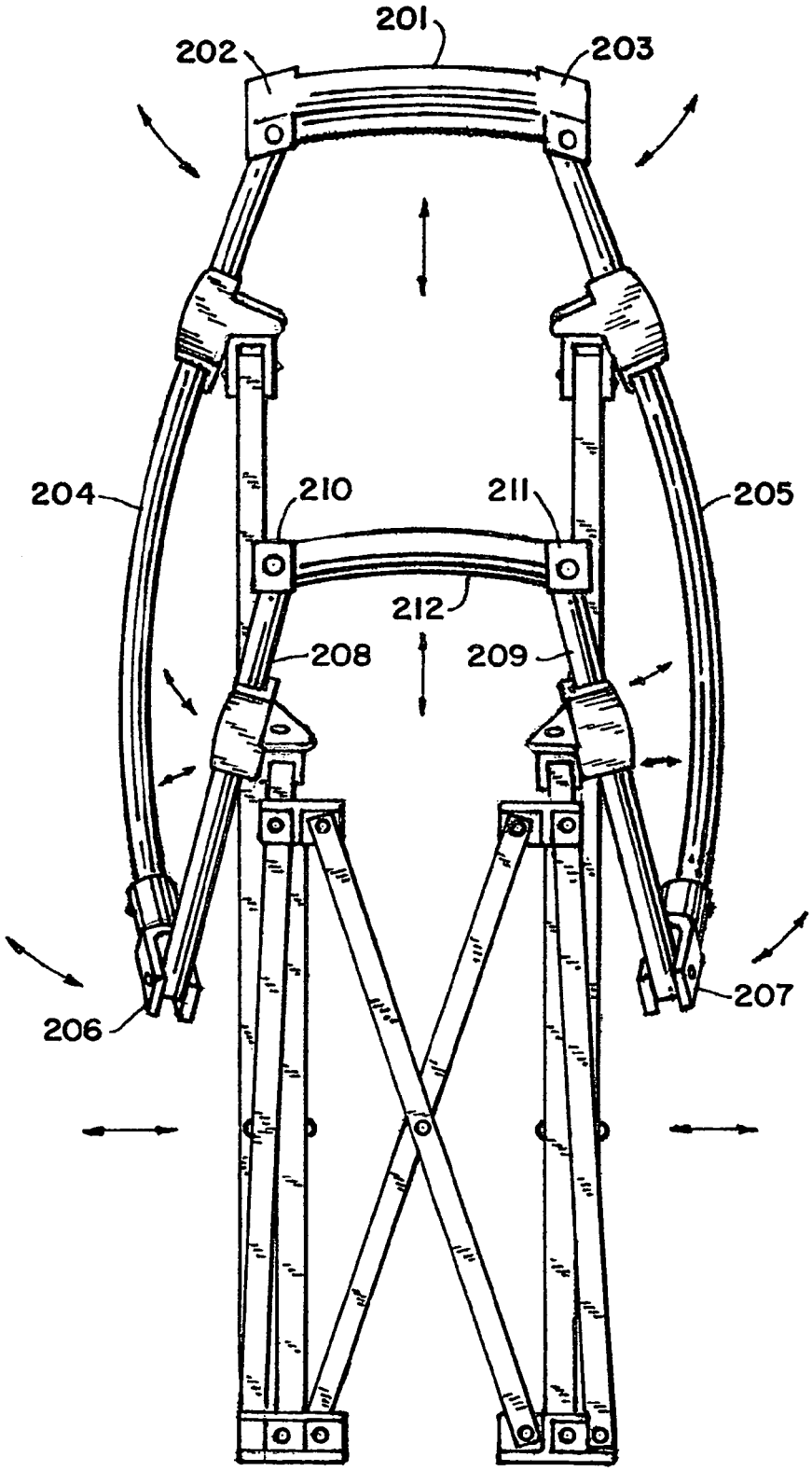
FIG. 3 is a front perspective view of the support frame in a closed position, without the net attached.

FIG. 3 shows the device 1 in a closed position. Closing the device 1 allows it to be easily transported and stored. In a closed position, the rear handle 201 may be located at a height above and aligned with the front handle 212 with the frame 220, 215 is standing upright. Pushing the handles 201 and 212 toward each other moves the frame 220, 215 from the opened position into the closed position. The frame members on the left and right sides of the retaining section may move analogously to the movement of human arms, respectively. As such, the pivot joints 206, 207 each act similarly to an elbow, the rear handle 201 acts similarly to shoulders and the front handle 212 acts similarly to wrists. FIG. 3 also illustrates the direction of movement of the handles 201, 212, and all four arcuate members 204, 205, 208, 209 that make up the circular frame 220 when moving between the open (FIG. 1) and closed (FIG. 2) positions. Compared to FIG. 2, the arcuate members 204, 205, 208, 209 form acute angles with respect to the pivot joints 206, 207 as opposed to an obtuse angle formed by the arcuate members 204, 205, 208, 209 when in the open position. Furthermore, the front handle 212 has folded in a direction towards the rear handle 201 to allow the once circular frame 220 to assume a clamshell position tailored for portability and ease of storage.

Figure 4:
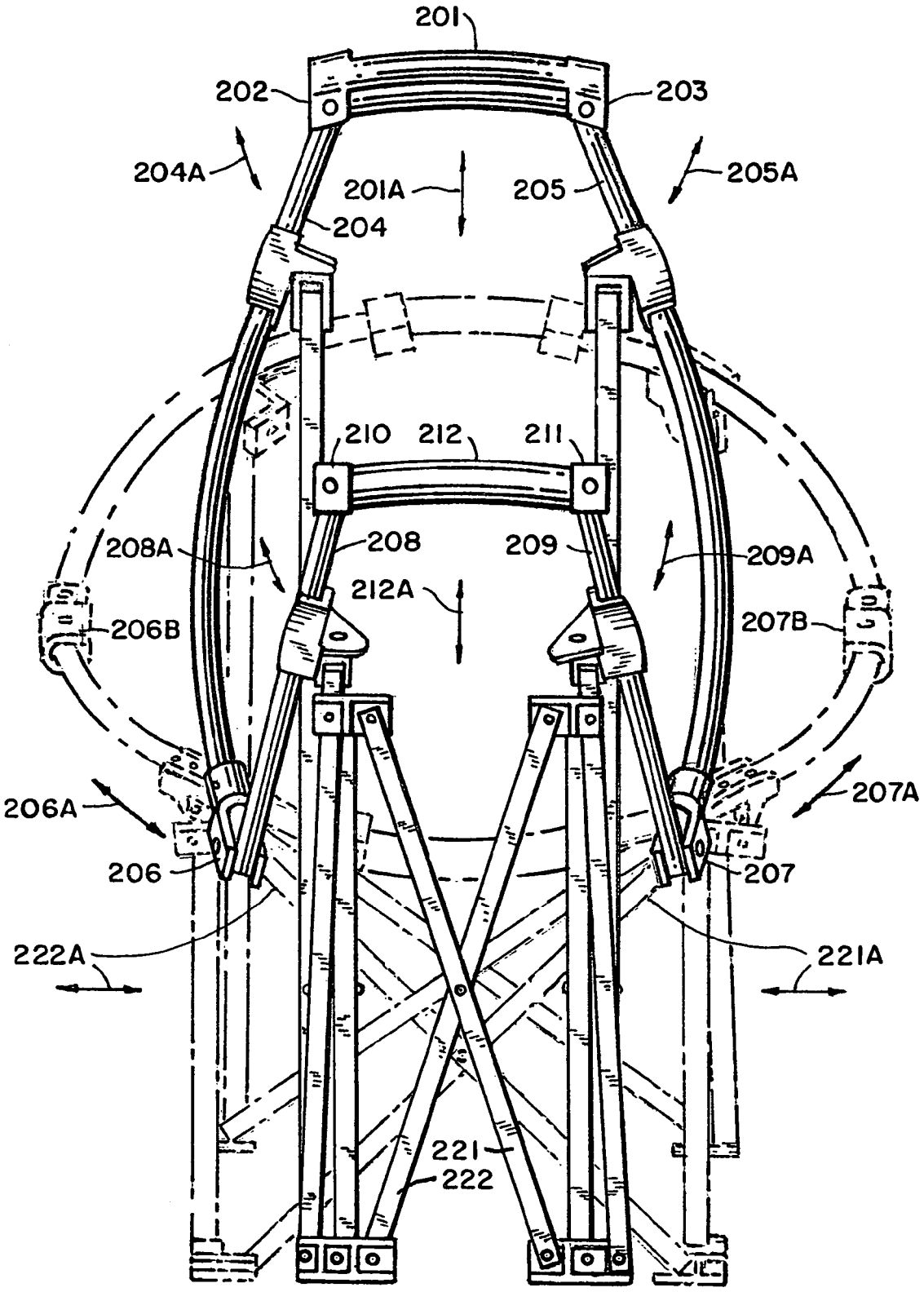
FIG. 4 is a front perspective view of the support frame moving between the a first closed position and a second open position.

FIG. 4 shows the device 1 in the in the open position (in phantom) (see, also, FIG. 2) and in between the closed position (FIG. 3). The progression of the device 1 from the open position to the closed or clamshell position is apparent with the movement of all arcuate members 204, 205, 208, 209 in relation to the handles 201, 212, pivot joints, and base 215.

The initial position shown in FIG. 3 is the device 1 in a closed position. To assume an open position (FIG. 2), a user may grasp and pull both handles 201, 212 away from one another. This movement, in turn causes the front 208, 209 and rear arcuate members 204, 205 to move away from each other and rotate in a direction opposite to the handles 212, 201 to which they are connected. The pivoted joints 210, 211, 206, 207, 202, 203 move upwards and outwards with respect to their initial positions and in a direction opposite to the arcuate members 204, 205, 208, 209 to which they are connected.

The front handle 212 is capable of directional motion shown by arrows 212A (FIG. 4). The rear handle 201 is capable of directional motion shown by arrows 201A. As indicated, the front handle 212 and rear handle 201 moves from the closed position to the open position when a user pulls the handles 212, 201 apart. As the front and rear handles 212, 201 moves to their respective open positions, all four arcuate members 208, 209, 204, 205 also move from the closed clamshell to the opened circular frame position. The first front arcuate member 208 pivots in a clockwise direction about connection 210 and the second front arcuate member 209 pivots in a counterclockwise direction about connection 211 until reaching a position extending in alignment with the front handle 212. These motions are shown by direction arrows 208A and 209A, respectively. The first rear arcuate member 204 pivots in a clockwise direction about connection 202 and second rear arcuate member 205 pivots in a counterclockwise direction about connection 203 until reaching a position extending in alignment with the rear handle 201. These motions are shown by direction arrows 204A and 205A, respectively. As the handles 201, 212 move away from one another, the arcuate members 208, 209, 204, 205 moves in the directions described above. The first front and first rear arcuate members 208 and 204 also pivot away from one another about the first pivot joint 206. The second front and second rear arcuate members 209 and 205 pivot away from one another about the second pivot joint 207. The two pivot joints simultaneously move as well. First pivot joint 206 moves upwards and outwards with the first front arcuate member 208 and first rear arcuate member 204. This motion is shown by direction arrows 206A. Second pivot joint 207 moves upwards and outwards with the second front arcuate member 209 and second rear arcuate member 205. This motion is shown by direction arrows 207A. The motion to open the pitching net frame ends when the arcuate members 208, 209, 204, 205 reach the respective stop points of the first and second pivot joints 206 and 207 identified by 206B and 207B.

Closing the device 1 involves reversing the movements of all elements of the apparatus. In order to close the device 1, a user grasps and moves the front and rear handles 212, 201 towards each other. This causes the first front arcuate member 208 to pivot in a counterclockwise direction about connection 210 and the second front arcuate member 209 pivots in a clockwise direction about connection 211 until reaching a stop position angled to the front handle 212. These motions are shown by direction arrows 208A and 209A, respectively. The first rear arcuate member 204 pivots in a counterclockwise direction about connection 202 and the second rear arcuate member 205 pivots in a clockwise direction about connection 203 until reaching a position angled to the rear handle 201. These motions are shown by direction arrows 204A and 205A, respectively. As the handles 201, 212 move towards one another, the arcuate members 208, 209, 204, 205 moves in the directions described above. The first front and first rear arcuate members 208, 204 also pivot towards each other about the first pivot joint 206. The second front and second rear arcuate members 209, 205 pivot towards each other about the second pivot joint 207. The two pivot joints 206, 207 simultaneously move as well. First pivot joint 206 moves downwards and inwards with the first front arcuate member 208 and the first rear arcuate member 204. This motion is shown by the direction arrows 206A. Second pivot joint 207 moves downwards and inwards with the second front arcuate member 209 and second rear arcuate member 205. This motion is shown by direction arrows 207A. The motion to close the device 1 ends when the first and second pivot joints 206, 207 reach their initial starting points in the clamshell form. The arcuate members' 208, 209, 204, 205 movement, from the clamshell position to the opened circular position, may be described as outwards and perpendicular to the closed positions. If the arcuate members 208, 209, 204, 205 are transitioning from an open position to a clamshell position, this motion may be described as bending inwards from an initial substantially flat circular plane to end in a position perpendicular to the plane.

While the collapsible net retaining section 220 makes its transition from a closed to an open position, the base 215 also assumes a change of shape. As the handles 201, 212 are pulled apart, and the arcuate members 208, 209, 204, 205, and pivot joints assume their end point positions to form a circular frame shape, the legs 221-224, 235, 236 of the base 215 move farther apart simultaneously. As the front arcuate members 208, 209 moves apart to open, the front crossed legs 221, 222 expand. Similarly, when the rear arcuate members 204, 205 move apart to open, the rear crossed legs 223, 224 expand. As the front and rear crossed legs 221-224 expand, the side crossed legs 235, 236 similarly expand. Front crossed legs 221, 222 initially start in a closed position with the crossed legs 221-224 forming four angles. The top and bottom angles are acute angles and the side angles are obtuse angles when the pitching net frame is in a closed position.

As the device 1 opens, crossed legs 221, 222 move farther apart. The top and bottom angles become obtuse angles, and the side angles become acute angles. The directional movements of the crossed legs 221, 222 may be shown by directional arrows 221A, 222A, respectively. The rear crossed legs 223, 224 have the same directional motion as the front crossed legs 221, 222. As the frame opens, the front and rear crossed legs 221-224 also move away from each other. In addition, the side crossed legs 235, 236 have directional movements similar to that of the front and rear crossed legs 221-224, except that they move apart in directions perpendicular to that of the front and rear crossed legs. The side crossed legs 235, 236 also move away from each other as the frame opens.

While the collapsible net retaining section 220 makes its transition from an open to a closed position, the base 215 also assumes a change of shape. As the handles 201, 212 are pushed together, and the arcuate members 204, 205, 208, 209, and pivot joints assume their initial closed positions to form a clamshell shape, the legs of the base move closer together simultaneously. As the front arcuate members 208, 209 move together, the front crossed legs 221, 222 contract together. Similarly, when the rear arcuate members 204, 205 move together to close, the rear crossed legs contract. As the front and rear crossed legs contract, the side crossed legs also contract similarly. Front crossed legs 221, 222 initially start in a closed position with the crossed legs forming four angles. The top and bottom angles are obtuse angles and the side angles are acute angles when the pitching net frame is in an open position. As the frame closes, crossed legs 221, 222 move closer together. The top and bottom angles become acute angles, and the side angles become obtuse angles. The directional movements of the crossed legs 221, 222 may be shown by directional arrows 221A, 222A, respectively. The rear crossed legs have the same directional motion as the front crossed legs. As the pitching net frame closes, the front crossed legs and rear crossed legs also move towards each other. In addition, the side crossed legs have directional motions similar to that of the front crossed legs and rear crossed legs, except that they move together in directions perpendicular to that of the front and rear crossed legs. The side crossed legs also move towards each other as the pitching net frame closes.

In an alternative embodiment, the pivot joints and handles may have locking mechanisms to keep the pitching net frame locked in either an open or a closed position. Furthermore, a slidable, adjustable locking mechanism may also be implemented on the pivotally connected areas in order to facilitate a system where a series of intermediate open or closed positions may be assumed to in effect change the size of the pitching target. This feature may also facilitate an easier carrying form than either the clamshell or the circular opened form.

Figure 5:
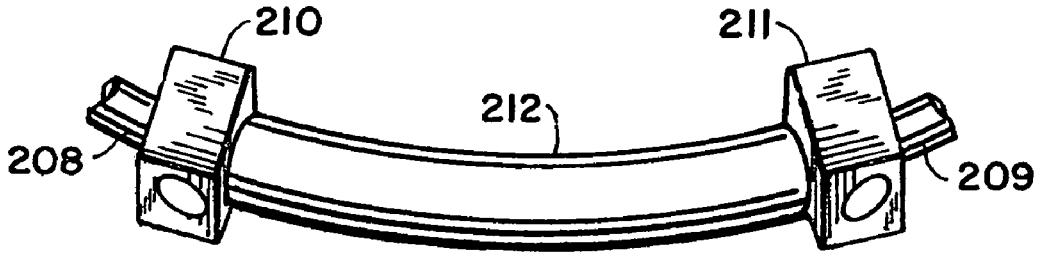
FIG. 5 shows an enlarged front perspective of a front handle of the frame and its pivot connections taken from the circle labeled 10 in FIG. 2.

FIG. 5 shows an enlarged front view of the front handle 212. The enlarged view offers a visualization of the range of motion of the first and second front arcuate members 208, 209 that are attached to each side of the handle 212. The first front arcuate member 208 pivots about connection 210 of the front handle 212 in a clockwise direction when opening and counterclockwise when closing, shown by the directions of the arrows 80 shown in FIG. 5. The second front arcuate member 209 pivots about connection 211 of the front handle 212 in a counterclockwise direction when opening and clockwise when opening, shown by the directions of the arrows 81 shown in FIG. 5. The motion of both the first front arcuate member 208 and second front arcuate member 209 can be described as moving in the direction opposite to the direction of the movement of the front handle 212.

Figure 6:
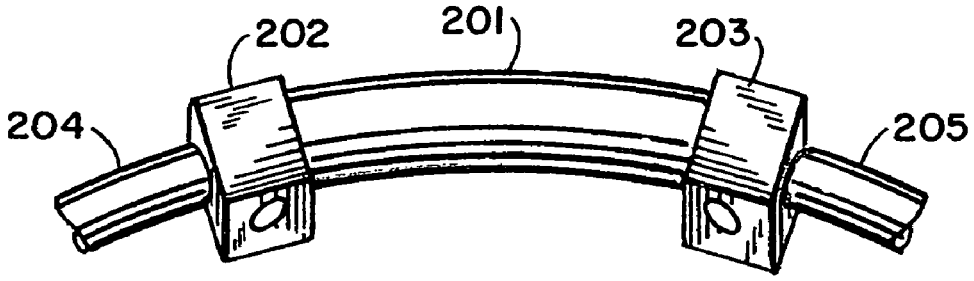
FIG. 6 shows an enlarged front perspective of the rear handle and its pivot connections taken from the circle labeled 20 in FIG. 2.

FIG. 6 shows an enlarged front view of the rear handle 201. The enlarged view offers a visualization of the range of motion of the arcuate members that are attached to each side of the handle 201. The first rear arcuate member 204 pivots about connection 202 of the rear handle 201 in a clockwise direction when opening and counterclockwise when closing, shown by the directions of the arrows 83 shown in FIG. 6. The second rear arcuate member 205 pivots about connection 203 of the rear handle 201 in a counterclockwise direction when opening and clockwise when closing, shown by the directions of the arrows 84 shown in FIG. 6. The motion of both the first rear arcuate member 204 and second rear arcuate member 205 can be described as moving in the direction opposite to the direction of movement of the rear handle 201.

Figure 7:
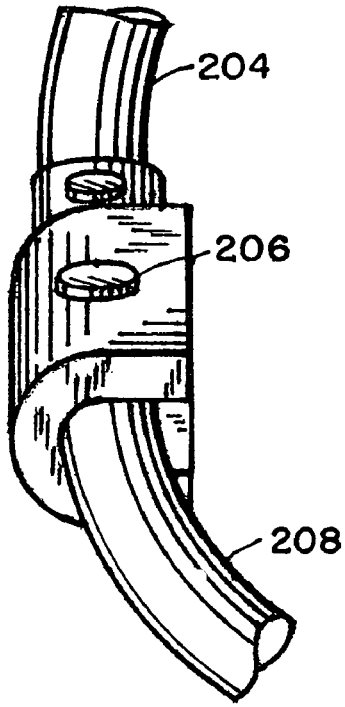
FIG. 7 shows an enlarged front perspective of the first pivot joint connected to two arcuate members taken from the circle labeled 30 in FIG. 2.

FIG. 7 shows an enlarged front view of the first pivot joint 206. The close up view shows the directions that the pivot joint moves with respect to the two arcuate members when the frame 1 opens and closes. The first rear arcuate member 204 and the first front arcuate member 208 pivot about the first pivot joint 206 towards each other when closing and away when opening as shown by the arrows 85, 86 in FIG. 7.

Figure 8:
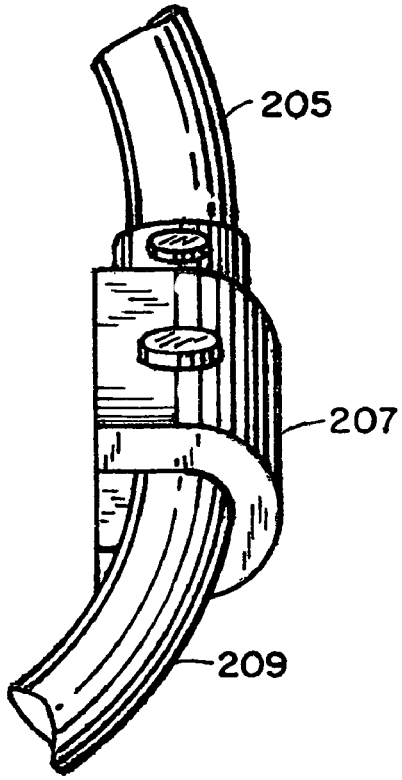
FIG. 8 shows an enlarged front perspective of the second pivot joint connected to two arcuate members taken from the circle labeled 40 in FIG. 2.

FIG. 8 shows an enlarged front view of the second pivot joint 207. The close up view shows the directions that the pivot joint moves with respect to the two arcuate members 205, 209 when the frame 1 opens and closes. The second rear arcuate member 205 and the second front arcuate member 209 pivot about the second pivot joint 207 towards each other when closing and away when opening as shown by the arrows 87, 88 in FIG. 8.

Figure 9:
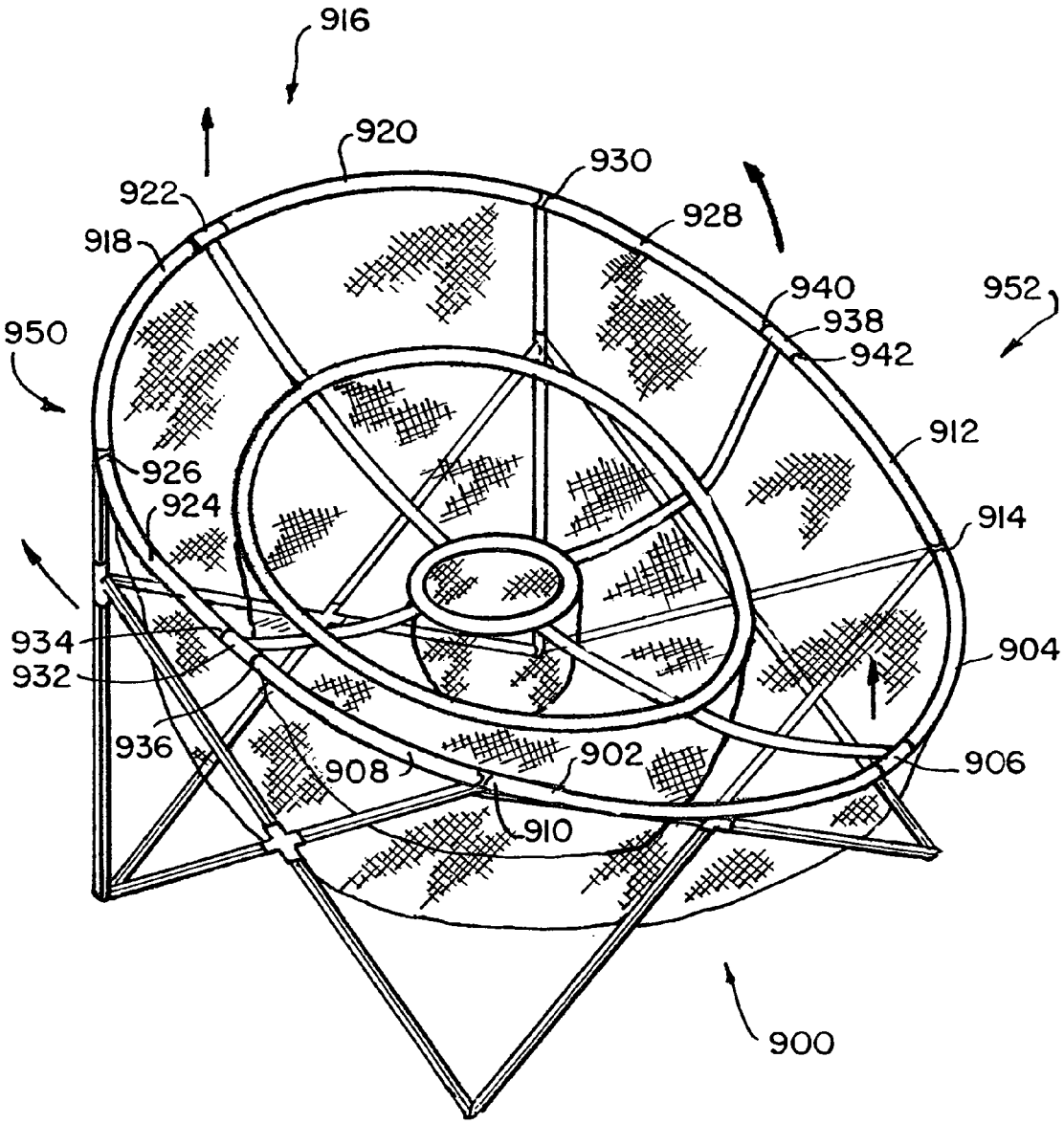
FIG. 9 shows a front perspective of an alternative embodiment in a closed position.

FIG. 9 shows the device 2 having handles 932 and 938 rotated 90 degrees from the position shown in FIGS. 1-8 in an open position with the target net 90 positioned thereon. The front portion 900 in this arrangement may be formed by a first front arcuate member 902, a second front arcuate member 904, and a front pivot joint 906 connected there between. A rear portion 916 may be formed by a first rear arcuate member 918, a second rear arcuate member 920, and a rear pivot joint 922 connected there between. A left side portion 950 may be formed by a first left side arcuate member 908, a second left side arcuate member 924, and a left side handle 932 connected there between. A right side portion 952 may be formed by a first right side arcuate member 912, a second right side arcuate member 928, and a right side handle 938 connected there between. The first front arcuate member 902 may be pivotally connected to the first left side arcuate member 908 at a pivot point 910. The second front arcuate member 904 may be pivotally connected to the first right side arcuate member 912 at a pivot point 914. The first rear arcuate member 918 may be pivotally connected to the second left side arcuate member 924 at a pivot point 926. The second rear arcuate member 920 may be pivotally connected to the second right side arcuate member 928 at a pivot point 930.

The connection of the front portion 900, rear portion 916, left side portion 950, and right side portion 952 may form a substantially circular or elliptical frame when in an open position. The circular shaped frame may be easily collapsed into a clamshell shape similar to that described above, with changes to be described below. The circular shaped frame may permit the device 2 to be opened and closed in one seamless motion. This is made possible by the pivotal connection between the arcuate members, pivot joints, pivot points, and handles. One broad motion of pulling the handles 932 and 938 apart or pushing the handles 932 and 938 together may cause the frame to move between the open and closed positions respectively. To further facilitate the ease of opening and closing the device 2, the handles 932 and 938 may be curved so as to fit the form of a human hand to provide an ergonomic advantage. The handles 932 and 938 may also include grips for receiving the fingers of the user. The collapsible base 944 of this embodiment may perform in a way that is substantially similar to the base shown in FIGS. 1-8. Pivot point 910 attaches the front portion 900 and the left side portion 950 to the collapsible base 944. Pivot point 914 attaches the front portion 900 and the right side portion 952 to the collapsible base 944. Pivot point 918 attaches the rear portion 916 and the left side portion 950 to the collapsible base 944. Pivot point 930 attaches the rear portion 916 and the right side portion 952 to the collapsible base 944.

Figure 10:
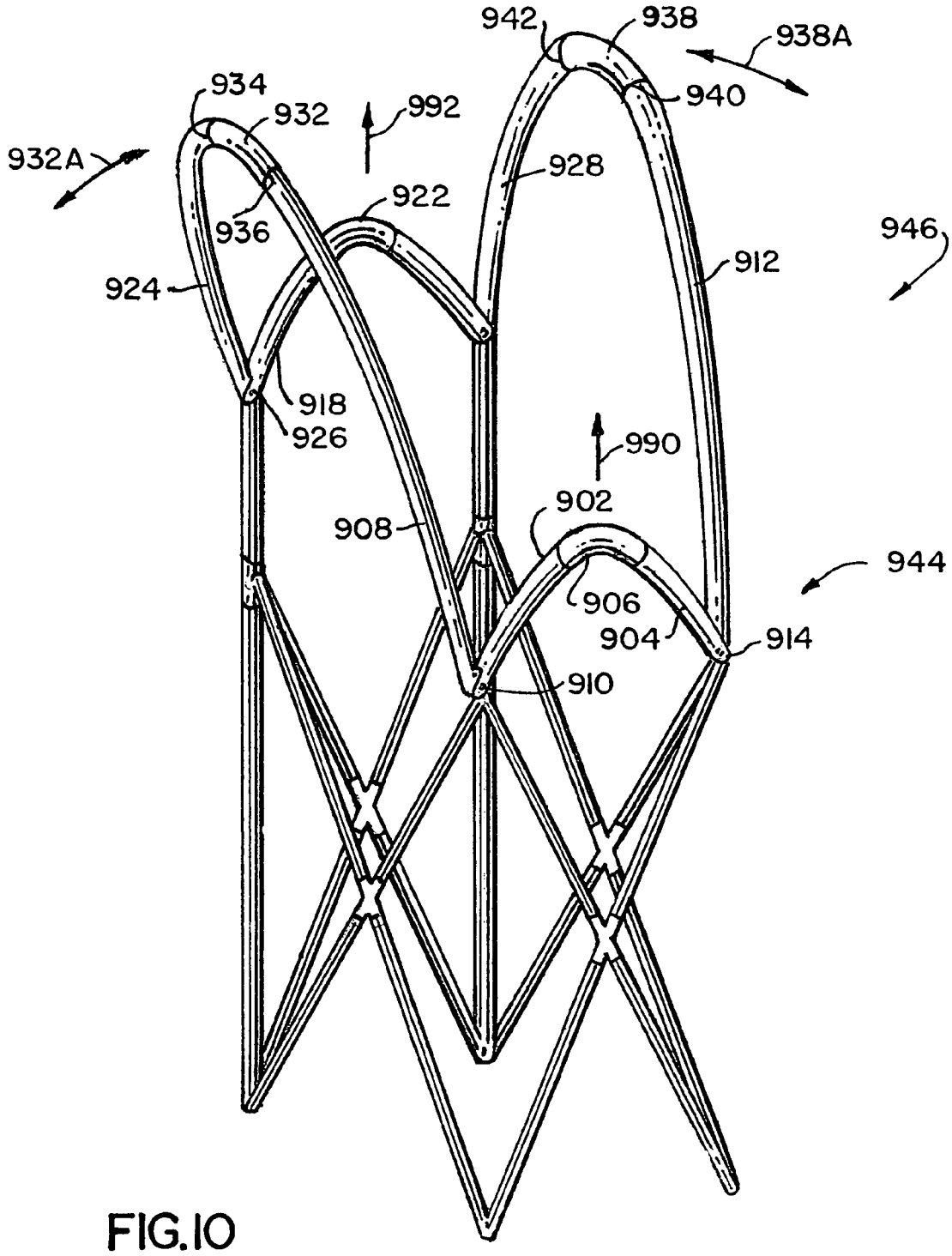
FIG. 10 shows a front perspective of the alternative embodiment in a transition position between open and closed.

FIG. 10 shows the device 2 in a closed position. Closing the device 2 allows it to be easily transported and stored. Pushing the handles 932 and 938 towards each other in the direction indicated by the arrows 932A and 938A moves the frame 946 from the opened position into the closed position. Arcuate members 908, 924, 928, and 912 all start at a position substantially parallel to the handles 932 and 938 in the open position and transition to a position substantially perpendicular or at an angle to the handles as the device is moved into a closed clamshell shape. The arcuate members 902, 904, 918, and 920 form obtuse angles with respect to the pivot joints 906 and 922 when in the open position. Arcuate members 902, 904, 918, and 920 move to form acute angles with respect to the pivot joints 906 and 922 when the device reaches a closed position. As the device closes, arcuate members 902, 904, 918, and 920 move in a direction towards the collapsible base 944. The direction of movement of the pivot joints 906 and 922 are indicated by direction arrow 990 and the direction of movement of the pivot joint 922 is indicated by the direction arrow 992 when moving into the closed position.

Figure 11:
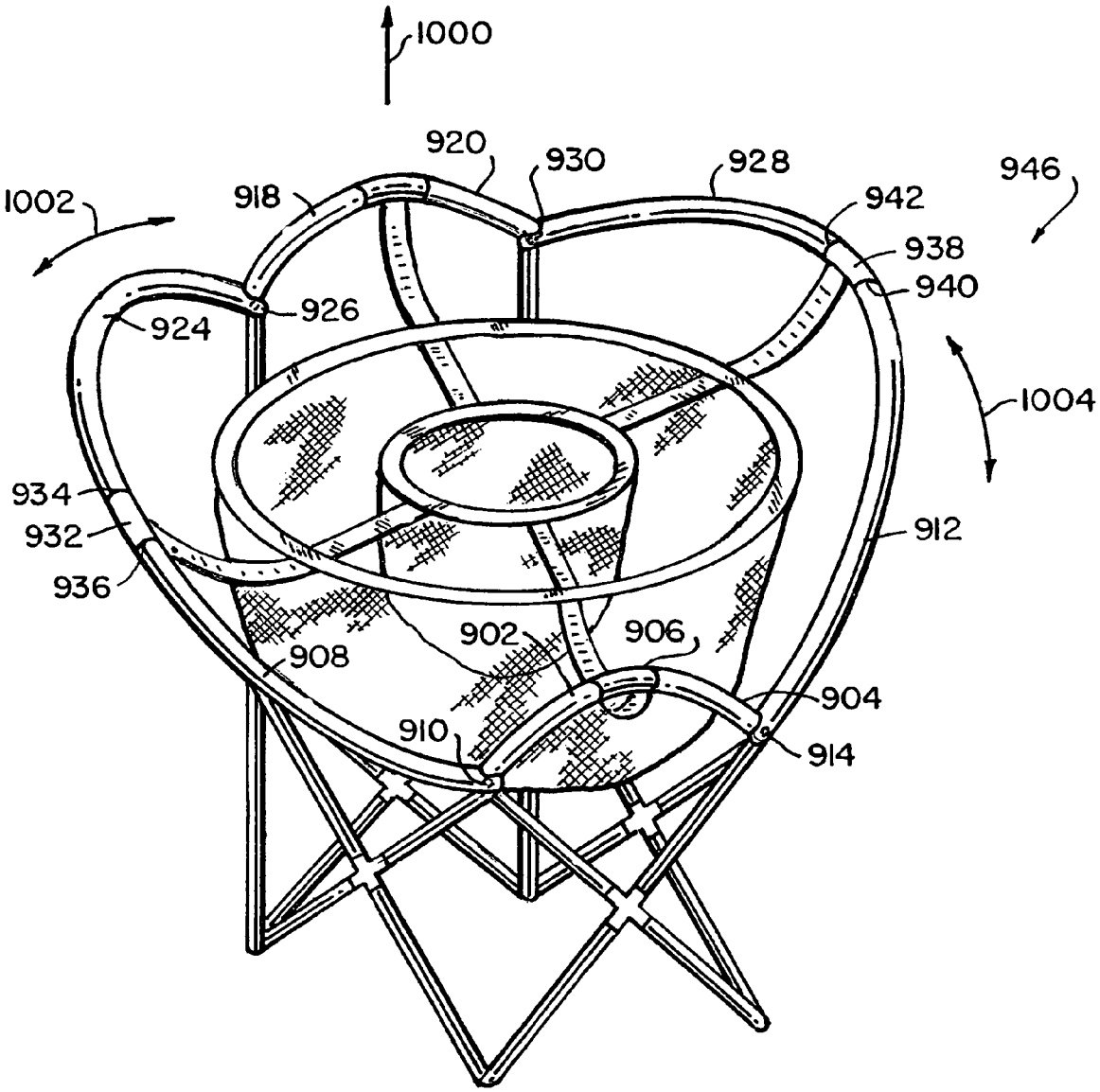
FIG. 11 shows a front perspective of the alternative embodiment in an open position.

FIG. 11 shows the device 2 in the process of being moved between the closed position (FIG. 10) and the open position (FIG. 9). The progression of the device 2 from the open position to the closed or clamshell position is explored below.

The initial position shown in FIG. 10 is the device 2 in a closed position. To assume an open position shown in FIG. 9, a user may grasp and pull both handles 932 and 938 away from one another. This movement, in turn causes the arcuate members 908, 924, 912, and 928 to pivot about their respective pivot point away from each other. In a closed position, the rear pivot joint 922 may be located aligned with but at different level than the front pivot joint 906. Pulling the handles 932 and 938 away from each other in the direction indicated by the arrows 1002 and 1004 moves the frame 946 from the closed position into the open position. Arcuate members 908, 924, 928, and 912 may all start at a position substantially perpendicular to or at an angle to the handles 932 and 938 in the closed position and transition to a position extending substantially parallel to the handles as the device opens. The arcuate members 902, 904, 918, and 920 form acute angles with respect to the irrespective pivot joints 906 and 922 when in the closed position. Arcuate members 902, 904, 918, and 920 move to form obtuse angles with respect to the irrespective pivot joints 906 and 922 when the device reaches an open position. As the device opens, arcuate members 902, 904, 918, and 920 move in a direction away from the collapsible base 944.

The left side handle 932 and the right side handle 938 are capable of directional motion shown by the arrows 1002 and 1004 respectively. The handles 932 and 938 move from the closed position to the open position when they are pulled apart by the user. As the handles 932 and 938 move to their respective open position, all eight arcuate members 902, 904, 908, 912, 918, 920, 924, and 928 may also move causing the device to move from the closed clamshell shape position to the opened circular frame position. The first left side arcuate member 908 pivots in a counterclockwise direction about connection 936 and the second left side arcuate member pivots in a clockwise direction about connection 934. The first right side arcuate member 912 pivots in a counterclockwise direction about connection 940 and the second right side arcuate member 928 pivots in a clockwise direction about connection 942. The first front arcuate member 902 pivots in a clockwise direction about pivot joint 906 and the second front arcuate member 904 pivots in a counterclockwise direction about pivot joint 906 until reaching a position extending substantially in alignment with pivot joint 906. The first rear arcuate member 918 pivots in a clockwise direction about pivot joint 922 and the second front arcuate member 920 pivots in a counterclockwise direction about pivot joint 922 until reaching a position extending in alignment with pivot joint 922. The first left side arcuate member 908 and first front arcuate member 902 pivot away from each other about pivot joint 910. The second front arcuate member 904 and first right side arcuate member 912 pivot away from each other about pivot joint 914. The second left side arcuate member 924 and first rear arcuate member 918 pivot away from each other about pivot joint 926. The second rear arcuate member 920 and second right side arcuate member 928 pivot away from each other about pivot joint 930. The two pivot joints 906 and 922 move downwards and outwards. The motion to open the pitching net frame ends when all arcuate members reach their respective stop points.

Closing the device 2 involves reversing the movements of all elements of the apparatus. In order to close the device 2, a user grasps and moves the handles 932 and 938 towards each other. As the handles 932 and 938 move to their respective closed position, all eight arcuate members 902, 904, 908, 912, 918, 920, 924, and 928 may also move or pivot causing the device to move from the opened circular frame position to the closed clamshell position. The first left side arcuate member 908 pivots in a clockwise direction about connection 936 and the second left side arcuate member pivots in a counterclockwise direction about connection 934. The first right side arcuate member 912 pivots in a clockwise direction about connection 940 and the second right side arcuate member 928 pivots in a counterclockwise direction about connection 942. The first front arcuate member 902 pivots in a counterclockwise direction about pivot joint 906 and the second front arcuate member 904 pivots in a clockwise direction about pivot joint 906 until reaching a position where the members form an acute angle about pivot joint 906. The first rear arcuate member 918 pivots in a counterclockwise direction about pivot joint 922 and the second front arcuate member 920 pivots in a clockwise direction about pivot joint 922 until reaching a position where the members form an acute angle about pivot joint 922. The first left side arcuate member 908 and first front arcuate member 902 pivot toward each other about pivot joint 910. The second front arcuate member 904 and first right side arcuate member 912 pivot toward each other about pivot joint 914. The second left side arcuate member 924 and first rear arcuate member 918 pivot toward each other about pivot joint 926. The second rear arcuate member 920 and second right side arcuate member 928 toward from each other about pivot joint 930. The two pivot joints 906 and 922 move upwards and inwards. The motion to close the pitching net frame ends when all arcuate members reach their initial start points.

The base of device 2 moves in a way substantially similar to that of the device 1 described above.

What is claimed is:

1. A method of opening a support device of the type capable of supporting a pitching net frame or the like comprising:

providing a frame;

grasping a left side and right side handle;

moving the left side and right side handles away from each other until the frame assumes a circular form;

pivoting of a first front arcuate member in a clockwise direction and a second front arcuate member in a counterclockwise direction about a front pivot joint;

pivoting of a first rear arcuate member in a clockwise direction and a second rear arcuate member in a counterclockwise direction about a rear pivot joint;

pivoting of said first front arcuate member and a first left side arcuate member about a first pivot point;

pivoting of said second front arcuate member and a first right side arcuate member about a second pivot point;

pivoting of said first rear arcuate member and a second left side arcuate member about a third pivot point;

pivoting of said second rear arcuate member and a second right side arcuate member about a fourth pivot point;

pivoting of said first left side arcuate member in a counterclockwise direction about said left side handle;

pivoting of said second left side arcuate member in a clockwise direction about said left side handle;

pivoting of said first right side arcuate member in a counterclockwise direction about said right side handle; and pivoting of said second right side arcuate member in a clockwise direction about said right side handle.

2. The method of claim 1, wherein the step of moving said left and right side handles causes a base to expand and provide support for the frame.

3. The method of claim 1, including a step of connecting a net to the frame.

4. A method of closing a support frame comprising:

grasping left side and right side handles;

moving the left side and right side handles toward each other until the frame assumes a closed clamshell form;

pivoting of a first front arcuate member in a counterclockwise direction and a second front arcuate member in a clockwise direction about a front pivot joint;

pivoting of a first rear arcuate member in a counterclockwise direction and a second rear arcuate member in a clockwise direction about a rear pivot joint;

pivoting of said first front arcuate member and a first left side arcuate member about a first pivot point;

pivoting of said second front arcuate member and a first right side arcuate member about a second pivot point;

pivoting of said first rear arcuate member and a second left side arcuate member about a third pivot point;

pivoting of said second rear arcuate member and a second right side arcuate member about a fourth pivot point;

pivoting of said first left side arcuate member in a clockwise direction about said left side handle;

pivoting of said second left side arcuate member in a counterclockwise direction about said left side handle;

pivoting of said first right side arcuate member in a clockwise direction about said right side handle; and pivoting of said second right side arcuate member in a counterclockwise direction about said right side handle.

5. The method of claim 4, wherein said step of moving the left and right side handles causes a base to contract and cause the frame to assume a clamshell position.

* * * * *